US010058891B2

(12) United States Patent
Gubbini et al.

(10) Patent No.: US 10,058,891 B2
(45) Date of Patent: Aug. 28, 2018

(54) ULTRASOUND DEVICE

(71) Applicant: Sound Technology Inc., State College, PA (US)

(72) Inventors: Alessandro Gubbini, State College, PA (US); Bradley Nelson, Boalsburg, PA (US); Kristine Gamble, Port Matilda, PA (US)

(73) Assignee: Sound Technology Inc., State College, PA (US)

( * ) Notice: Subject to any disclaimer, the term of this patent is extended or adjusted under 35 U.S.C. 154(b) by 160 days.

(21) Appl. No.: 14/773,093

(22) PCT Filed: Mar. 25, 2013

(86) PCT No.: PCT/US2013/033642
§ 371 (c)(1),
(2) Date: Sep. 4, 2015

(87) PCT Pub. No.: WO2014/123556
PCT Pub. Date: Aug. 14, 2014

(65) Prior Publication Data

US 2016/0038974 A1 Feb. 11, 2016

Related U.S. Application Data

(60) Provisional application No. 61/760,779, filed on Feb. 5, 2013.

(51) Int. Cl.
*B06B 1/06* (2006.01)

(52) U.S. Cl.
CPC ..... *B06B 1/0622* (2013.01); *B06B 1/0629* (2013.01)

(58) Field of Classification Search
CPC ..... B06B 1/06; B06B 1/0622; B06B 1/0629; G06T 5/002; G06T 5/10; G06T 7/0012; G06T 2207/10116; G06T 2207/20048; G06T 2207/30061; G06T 2210/41; G06T 2207/20016; G06T 2207/30004; A61B 6/5282
See application file for complete search history.

(56) References Cited

U.S. PATENT DOCUMENTS 7,838,337 B2 * 11/2010 Marimuthu ..... H01L 21/565 257/E21.5
8,026,584 B2 * 9/2011 Kim ..... H01L 23/49827 257/686
9,287,248 B2 * 3/2016 Guzek ..... H01L 25/18
(Continued)

OTHER PUBLICATIONS

International search report for PCT/US2013/33642 published as WO 2014/123556, dated Aug. 14, 2014.
(Continued)

*Primary Examiner* — Isam A Alsomiri
*Assistant Examiner* — Amie M Ndure
(74) *Attorney, Agent, or Firm* — Anthony M. Del Zoppo, III; Driggs, Hogg, Daugherty & Del Zoppo, Co., LPA

(57) ABSTRACT

An ultrasound system (100) includes an ultrasound transducer array and a component (108) with electronics (110) embedded in a material (112) with at least one redistribution layer (114) electrically coupled to the embedded electronics, wherein the at least one redistribution layer electrically couples the ultrasound transducer array and the electronics.

29 Claims, 6 Drawing Sheets

(56) References Cited

U.S. PATENT DOCUMENTS

2003/0028105 A1* 2/2003 Miller ..... A61B 8/12 600/437
2003/0028108 A1* 2/2003 Miller ..... A61B 8/4483 600/437
2005/0121734 A1* 6/2005 Degertekin ..... A61B 5/0215 257/414
2005/0169107 A1* 8/2005 Thomenius ..... B06B 1/0207 367/155
2005/0272183 A1* 12/2005 Lukacs ..... B06B 1/0622 438/109
2006/0078473 A1* 4/2006 Murakami ..... B01L 3/502792 422/400
2007/0148999 A1* 6/2007 Haider ..... H04R 1/00 439/67
2007/0222339 A1* 9/2007 Lukacs ..... B06B 1/0622 310/335
2008/0106976 A1* 5/2008 Davidsen ..... B06B 1/0622 367/140
2008/0134793 A1* 6/2008 Woychik ..... B06B 1/0292 73/649
2008/0273424 A1* 11/2008 Wodnicki ..... A61B 8/0833 367/180
2008/0315331 A1* 12/2008 Wodnicki ..... B06B 1/0629 257/414
2009/0015101 A1* 1/2009 Petersen ..... B06B 1/0622 310/327
2009/0182229 A1* 7/2009 Wodnicki ..... B06B 1/0622 600/437
2011/0071397 A1* 3/2011 Wodnicki ..... B06B 1/0629 600/459
2012/0266518 A1* 10/2012 Hoggan ..... A01M 23/34 43/87
2012/0267981 A1* 10/2012 Morris ..... A61B 8/4483 310/314
2012/0273946 A1* 11/2012 Kim ..... H01L 25/0657 257/738
2012/0321168 A1* 12/2012 Deitz ..... A61B 5/0555 382/132

OTHER PUBLICATIONS

Chiao, Thomas, Apperture formation on reduced-channel Arrays using the transmit-Receive apodization matrix, 1996 IEEE Ultrasonics Symposium-1567.
Lockwood, Foster, Optimizing the Radiation Pattern of Sparse Periodic Two-Dimensional Arrays, 1996 IEEE Transactions on Ultrasonics, vol. 43, No. 1.
Nikolov, Jensen, Application of different spatial sampling patterns for sparse array transducer design, 2000 Ultrasonics 37 pp. 667-671.
Smith, Pavy, von Ramm, High-Speed Ultrasound Volumetric Imaging System-Part I: Transducer Design and Beam Steering, 1991 IEEE Transactions on Ultrasonics.
Tezuka et al., A Two-Dimensional Array Probe that has a Huge Number of Active Channels, 2003 IEEE Ultrasonics Symposiium-960.

* cited by examiner

ULTRASOUND DEVICE

RELATED APPLICATION

This application is a national filing of PCT application Serial No. PCT/US2013/33642, filed Mar. 25, 2013, published as WO2014/123556 on Aug. 14, 2014, which claims the benefit of priority of U.S. provisional patent application Ser. No. 61/760,779 filed on Feb. 5, 2013, confirmation number 8596, and entitled "ULTRASOUND PROBE WITH ELECTRONICS EMBEDDED IN A MATERIAL AND WITH A REDISTRIBUTION LAYER IN ELECTRICAL COMMUNICATION WITH TRANSDUCER ELEMENTS OF A TRANSDUCER ARRAY OF THE PROBE" which is incorporated herein in its entirety by reference.

TECHNICAL FIELD

The following generally relates to an ultrasound and more particularly to an ultrasound device including an ultrasound transducer with a component that includes embedded electronics and a redistribution layer(s) in electrical communication with the ultrasound transducer, and is described with particular application to an ultrasound imaging system. However, the following is also amenable to other ultrasound systems.

BACKGROUND

Ultrasound (US) imaging has provided useful information about the interior characteristics of an object or subject under examination. An US imaging system has included a probe with a transducer array of transducer elements. The transducer elements are configured to transmit ultrasound signals that traverse an examination region and to receive echo signals produced in response to the signals interacting with structure in the examination region. The echo signals are optionally pre-processed and then routed from the probe to processing electronics. A two-dimensional (2D) array may have thousands of transducer elements. With such a configuration, a large number of signals would need to be routed off the probe to the processing electronics.

One approach to handling such a large number of signals is to integrate certain electronics (e.g., an analog to digital converter (ADC), a multiplexor, etc.) into the probe, which, for example, could reduce the number of signals read out from the probe from thousands of signals to hundreds of signals. However, with this approach, there would need to be thousands of interconnects between the electronics in the probe and the transducer array. Unfortunately, drilling thousands of holes and/or routing thousands of electrical connections between the limited space of the footprints of the transducer and the electronics can be challenging and costly.

Another approach has included integrating an interposer, which has been configured to reduce the number of signals from thousands to hundreds, between the electronics in the probe and the transducer array. In this instance, the electronics have been packaged on printed circuit boards (PCB's) that are attached to one or more sides of the interposer via solder joints, with the transducer array being attached to the opposing side of the interposer via solder joints or conductive adhesives. With this configuration, the number of signals that are read out from the electronics can be reduced, along with complexity and cost.

Unfortunately, adding an interposer between the transducer array and the electronics introduces additional material(s) and therefore acoustic impedance mismatch boundaries (e.g., interposer/transducer array and interposer/electronics) and/or may introduce air between the transducer array and the electronics, which may result in unintended acoustic reflections and thus degrade image quality. Furthermore, the heat applied to melt and flow the solder that joins the electrical contacts of the interposer and the transducer array may degrade the transducing properties of the transducer array.

SUMMARY

Aspects of the application address the above matters, and others.

In one aspect, an ultrasound system includes an ultrasound transducer array and a component with electronics embedded in a material with at least one redistribution layer electrically coupled to the embedded electronics, wherein the at least one redistribution layer electrically couples the ultrasound transducer array and the electronics.

In another aspect, a hand-held ultrasound scanner includes a housing, an ultrasound device, and a control and/or processing portion, wherein the housing is a single enclosure that houses the ultrasound device and the control and/or processing portion. The ultrasound device includes an ultrasound transducer array and a material with electronics embedded therein and including at least one redistribution layer electrically coupled to the embedded electronics, wherein the at least one redistribution layer electrically couples the ultrasound transducer array and the electronics.

In another aspect, an ultrasound device includes an ultrasound transducer array, a component including electronics and a redistribution layer, and means for electrically coupling the ultrasound transducer array and the electronics.

Those skilled in the art will recognize still other aspects of the present application upon reading and understanding the attached description.

BRIEF DESCRIPTION OF THE DRAWINGS

The application is illustrated by way of example and not limitation in the figures of the accompanying drawings, in which like references indicate similar elements and in which.

DETAILED DESCRIPTION

Figure 1:
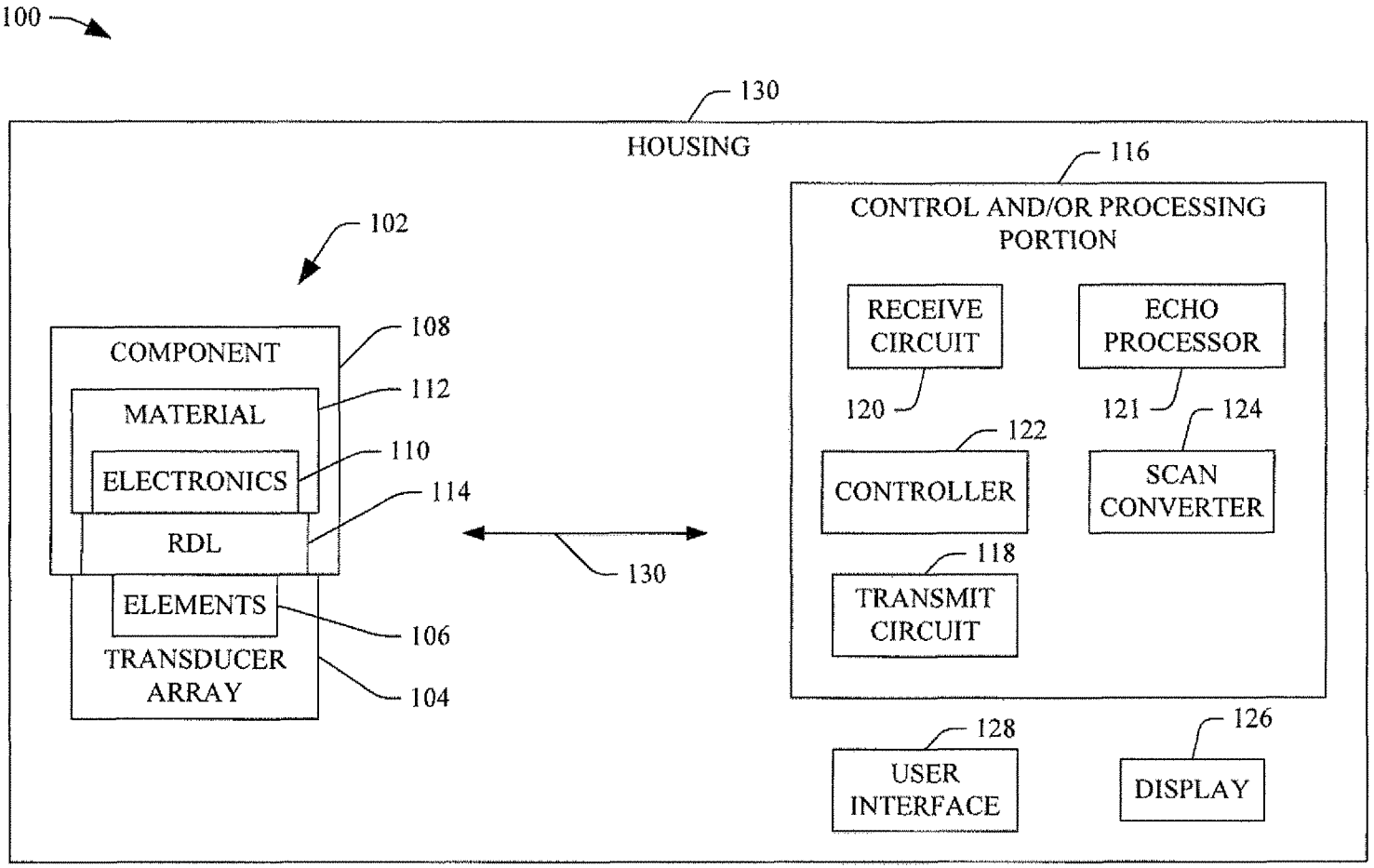
FIG. 1 schematically illustrates an example ultrasound system with a component with embedded electronics and a redistribution layer coupled to a transducer array.

FIG. 1 schematically illustrates an ultrasound (US) system 100.

The ultrasound system 100 includes a one-dimensional (1D) or two-dimensional (2D) transducer array 104 of transducer elements 106. The ultrasound system 100 further includes a component 108 with at least, electronics 110, a material 112 and a redistribution layer (RDL) 114 in electrical communication with the electronics 110. As shown in the illustrated embodiment, the transducer array 104 and the component 108 are coupled via the RDL 114, rendering an ultrasound device 102.

As described in greater detail below, in one non-limiting instance, the electronics 110 are embedded in the material 112 and the at least one redistribution layer (RDL) 114 includes one or more layers of traces (not visible) that are in electrical communication with the electronics 110, and, when the transducer array 104 is installed or coupled with the component 108, that electrically couples the transducer elements 106 and the electronics 110. Generally, the RDL 114 routes signals from electrical connections of the transducer elements 106 of the transducer array 104 to the electronics 110.

In one instance, the RDL 114 is used to map the signals to particular circuitry of the electronics 110 for processing by the electronics 110. As a result fewer signals are read out from the electronics 110 relative to the number of signals from the transducer array 104. Such a configuration may mitigate having to have individual readout channels for each of the transducer elements 106 and thus may reduce complexity and cost. Such a configuration may also mitigate adding a device (e.g., an interposer) between the transducer elements 106 and the electronics 110 to reduce the number of signals read out.

Such a configuration may also mitigate increasing a distance between the transducer array 104 and the electronics 110, e.g., with an interposer, which may improve acoustic performance and/or image quality, relative to a configuration which includes an interposer or the like. Such a configuration may also mitigate introducing boundaries (e.g., interposer/electronics 110 and interposer/transducer array 104) and/or introducing air between the transducer array 104 and the electronics 110, both of which may result in mismatch of acoustic impedance and consequently, unintended acoustic reflections or reverberations and degrade image quality.

The ultrasound system 100 further includes a control and/or processing portion 116. Data are conveyed from the ultrasound device 102 to the control and/or processing portion 116 via readout electronics 130, and control signals conveyed from the control and/or processing portion 116 to the ultrasound device 102 via the communication channel 130.

The control and/or processing portion 116 includes transmit circuitry 118 that controls excitation of the elements 106 and receive circuitry 120 that controls reception of echo signals by the elements 106. The control and/or processing portion 116 further includes an echo processor 121 that processes received echo signals. Such processing may include beamforming (e.g., delay and sum, etc.) and/or otherwise processing the echo signals, e.g., to lower speckle, to improve specular reflector delineation, to filter the echo signals via FIR and/or IIR filters, etc., and/or in connection with synthetic aperture, shear wave elastography, and/or other imaging modes.

The control and/or processing portion 116 further includes a controller 122 that controls the transmit circuitry 118, the receive circuitry 120, and the echo processor 121. Such control may include controlling the frame rate, transmit angles, energies and/or frequencies, transmit and/or receive delays, processing of echo signals, the imaging mode, etc. The control and/or processing portion 116 further includes a scan converter 124 that coverts processed echo signals and generates data for display. The ultrasound system further includes a display 126, which visually presents the scan converted data, and a user interface 128, which includes input controls and/or output displays for interacting with the system 100.

It is to be understood that the illustrated control and/or processing portion 116 is provided for explanatory purposes and is not limiting. In other embodiments, the control and/or processing portion 116 may include other components, including similar and/or different components, more or less components, etc.

In the illustrated embodiment, at least the device 102, the processing portion 116, the display 126, and the user interface 128 are housed in a single enclosure or housing 130. Such a configuration may be part of a hand-held or other ultrasound apparatus. A hand-held ultrasound apparatus may utilize internally located power, e.g., from a power source such as a battery, a capacitor or other power storage device located in the housing 130, to power the components therein, and/or power from an external power source. An example of a hand-held device are described in U.S. Pat. No. 7,699,776, entitled "Intuitive Ultrasonic Imaging System and Related Method Thereof," and filed on Mar. 6, 2003, which is incorporated herein in its entirety by reference. [brn1][A2]

Alternatively, the device 102 is housed in a probe and the control and/or processing portion 116, the display 126, and the user interface 128 are part a console or separate computing system. In this configuration, the probe and console have complementary interfaces and communicate with each other, over a hard wired and/or wireless channel, via the interfaces.

Figure 2:
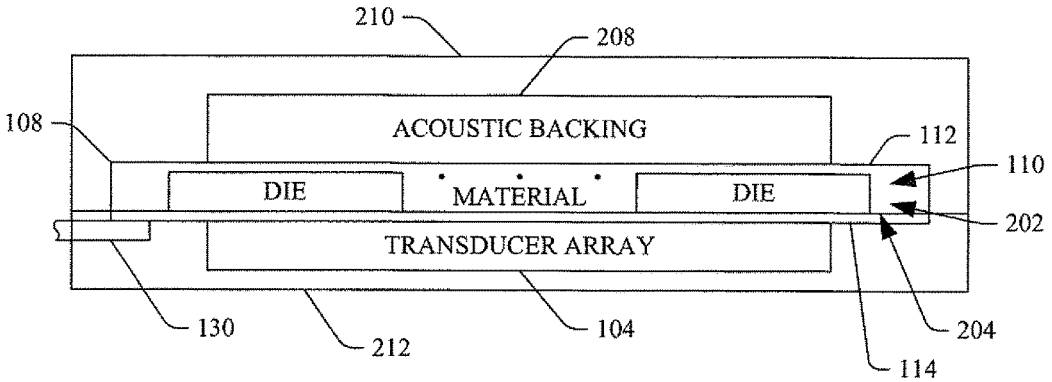
FIG. 2 schematically illustrates an example of the component with embedded electronics and the redistribution layer coupled to the transducer array.

FIG. 2 schematically illustrates an example of the component 108 in connection with the transducer array 104. In this example, the electronics 110 include a plurality of dies 202 (or integrated circuits with semiconductor material fabricated with electrical circuits) embedded in the material 112 and electrically coupled to the RDL 114.

Figure 3:
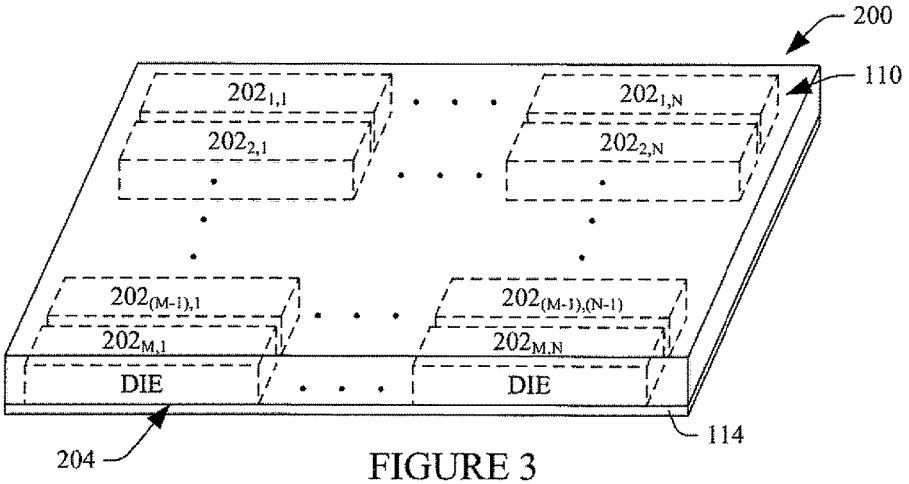
FIG. 3 schematically illustrates a perspective view of the example of the component with embedded electronics and the redistribution layer coupled to the transducer array.

Briefly turning to FIG. 3, in one instance, the plurality of dies 202 includes an M×N matrix 200 of dies $\mathbf{202}_{1.1}$, . . . , $\mathbf{202}_{1.N}$, $\mathbf{202}_{2.1}$, . . . , $\mathbf{202}_{2.N}$, . . . , $\mathbf{202}_{(M\text{-}1).1}$, . . . , $\mathbf{202}_{(M\text{-}1).(N\text{-}1)}$, . . . , $\mathbf{202}_{M.1}$, . . . , $\mathbf{202}_{M.N}$ (where M and N are integers greater than zero) tiled in a plane (e.g., linear, as shown, or curved such as convex or concave) of the material 112 with a major surface 204 that is adjacent to the redistribution layer 114. Examples of suitable matrices include, but are not limited to, M=4 and N=1, M=4 and N=2, M=5 and N=2, M=10 and N=10, etc.

The embedded electronics 110 can be based on wafer level packaging approaches such as FOWLP (Fan Out Wafer Level Packaging), eWLB (Embedded Wafer Level Ball Grid Array), embedded die and/or other wafer level packaging approaches in which multiple dies can be embedded into a material with one or more redistribution layers on one or both sides. Thinning the wafer may also allow the wafer to be flexed in a convex, concave or other geometry.

With FOWLP and eWLB, the dies 202 can be embedded in a mold compound of the material 112 in a shape of (e.g., 200 millimeters to 400 millimeters, such as 300 millimeters, etc.) reconstituted wafers and processed using silicon back-end and/or other approaches. In one instance, this allows for a large number of packages to be processed at the same time, which may provide cost benefits, relative to processing individual packages. Alternatively, the dies 202 can be embedded in a PCB or PWB type of laminate infrastructure and processed in panels.

With reference to FIGS. 2 and 3, the redistribution layer 114 can be applied to the material 112 via thin film or other approach. Other approaches, including solder, are also contemplated herein. The redistribution layer 114 can be thin, for example, to 20 to 50 microns, which may mitigate an impact on a functionality of the transducer array 104, and provides multiple layers of fine pitch layers of routing traces.

With continuing reference to FIGS. 2 and 3, the redistribution layer 114 maps signals from the transducer array 104 to the layout of the dies 202 (Fan Out) and/or electrically connect multiple dies 202 together via electrical traces. In another instance, the layout can be mapped such that a die 202 with predetermined functionality and pad layout is configured into a different 2D array geometry, e.g., transducers of different size, different number of elements 106, different element spacing, etc.

With reference to FIG. 2, the readout interface 130 is also in electrical communication with the one or more layers of electrical traces of the redistribution layer 114, and, signals are routed from the electronics 110 to the readout interface 206 via the electrical traces of the redistribution layer 114. In this example, the readout interface 206 extends in a direction along the major surface 204 of the matrix 200 of dies 202. In other embodiments, the readout interface 130 could otherwise extend in the component 108, for example perpendicular to major surface 204.

An acoustic backing 208 is affixed at a side of the material 112 opposite the side with the redistribution layer 114. In one instance, the acoustic backing 208 is composed of material that it is highly attentive acoustically and thick enough to mitigate acoustic echoes returning to the transducer array 104. Furthermore, the acoustic backing 208 can be composed of a material that has an acoustic impedance that substantially matches the impedance of the die 202, which facilitates mitigating an acoustic mismatch. An optional encapsulate 210 at least covers portions of the material 112.

An acoustic window 212 at least covers portions of the transducer array 104, the readout interface 206, portions of the redistribution layer 114, and portions of the material 112. The protective layer 212 may include an acoustic lens or the like.

Figure 4:
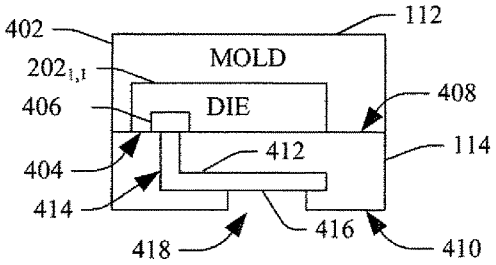
FIGS. 4 and 5 schematically illustrate example electrical coupling between a die of the electronics and the redistribution layer.

An example of a sub-portion (with a single die 202) of the material 112 with the RDL 114 thereon is illustrated in FIG. 4. Note that the geometry of the components in FIG. 4 is not limiting and is provided for explanatory purposes. In FIG. 4, the material 112 includes a mold compound 402 that surrounds the die $\mathbf{202}_{1.1}$ with the exception of a side 404 of the die $\mathbf{202}_{1.1}$ facing the RDL 114. The die $\mathbf{202}_{1.1}$ includes an electrical contact 406 on the side 404. The electrical contact 406 is in electrical communication with electrical circuitry (not visible) of the die $\mathbf{202}_{1.1}$ and provides an electrical path between the electrical circuitry of the $202_{1.1}$ and one or more components external to the die $\mathbf{202}_{1.1}$.

The RDL 114 includes a first side 408 which faces the side 404 of the die $\mathbf{202}_{1.1}$ and a second side 410, which opposes or is opposite to the side 408. An electrically conductive trace 412 extends from a via 414 of the RDL 114 that extends from the electrical contact 406 to the side 410 of the RDL 114. Other shapes, including straight, curved, etc., of the electrical contact 412 are contemplated herein. In the illustrated embodiment, an end region 416 of the trace 412 is exposed (in that it is not covered by any material) and is in a recess 418 of the RDL 114. The end region 418 provides an electrically conductive pad, which may be used to electrically couple the die $\mathbf{202}_{1.1}$ to a transducer element 106 (FIG. 1) of the transducer array 104 (FIGS. 1 and 2) or a readout interface (discussed below).

Figure 5:
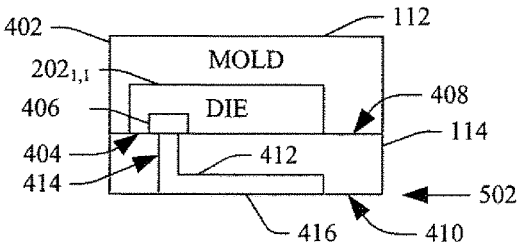

The die $\mathbf{202}_{1.1}$ is shown with a single electrical contact 416. However, in another instance, the die $\mathbf{202}_{1.1}$ includes more than one electrical contact 416. With such a configuration, at least a second via and a second trace is included and used to electrically couple the electrical circuitry of the die $\mathbf{202}_{1.1}$ to a second transducer element 106 (FIG. 1) of the transducer array 104 (FIGS. 1 and 2) or the readout interface. In yet another embodiment, as shown in FIG. 5, the end region 416 of the trace 412 is exposed in a plane 502 with the side 410 of the RDL 114 and not in the recess 418 shown in FIG. 4. In yet another embodiment, the end region 416 protrudes out farther than the side 410 of the RDL 114.

With reference to FIGS. 2, 3, 4 and 5, the RDL 114 is coupled with the transducer array 104 with the end regions 416 of the traces 412 of the RDL 114 in electrical communication with the transducer elements 106 (FIG. 1) of the transducer array 104.

A suitable coupling includes a conductive coupling. Examples of conductive couplings include a solder (low and/or high temperature), a conductive adhesive (e.g., a silver epoxy, etc.), and/or other conductive material. An example of a conductive adhesive is a conductive adhesive with a low temperature cure, e.g., less than 100° C. such as approximately 80° C., 50° C., or other temperature. Such a conductive adhesive mitigates degrading the transducing properties of the transducer array 104, which may occur with higher temperatures.

Another suitable coupling includes a non-conductive coupling. As described in further detail below, an example of a non-conductive coupling includes a non-conductive adhesive with an electrically conductive protrusion or stand-off (e.g., a copper protrusion, an elastomeric interconnect, other protrusion, etc.), which is in electrical communication with the end regions 416 and the transducer elements 106.

FIGS. 6, 7, 8, 9 and 10 illustrate examples of couplings between the transducer array 104 and the component 108.

Figure 6:
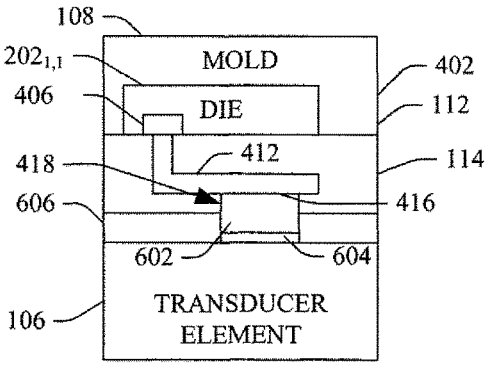
FIGS. 6, 7, 8, 9 and 10 schematically illustrate example couplings between the component and the transducer array.

Initially referring to FIG. 6, a conductive epoxy 602 is located in the recess 418 and is in electrical communication with the end region 416 of the trace 412 and a plating 604 of the transducer element 106. In the illustrated embodiment, a filler 606 is located between the RDL 114 and the transducer element 106. The filler 606 may reduce ringing (which may cause shallow depth image artifacts/noise) relative to a configuration in which the filler 606 is omitted and an air gap is located between the RDL 114 and the transducer element 106. The air gap may render the transducer element 106 more sensitive, relative to the configuration with the filler 606.

Figure 7:
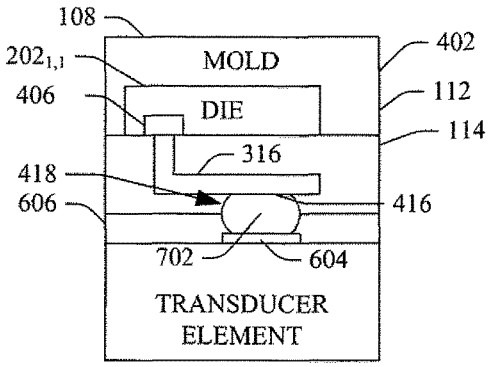

Turning to FIG. 7, a solder 702 is located in the recess 418 and is in electrical communication with the end region 416 of the trace 412 and the plating 604 of the transducer element 106. Similar to FIG. 6, in one instance, the filler 606 is located between the RDL 112 and the transducer element 106, and in another instance, the filter 606 is omitted.

Figure 8:
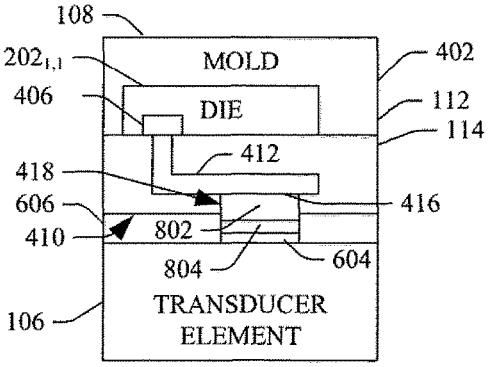

In FIG. 8, a conductive protrusion 802 (e.g., a copper pillar, a raised elastomeric interconnect, or other material)

extends from the end region 416 of the trace 412 and protrudes beyond the side 410 of the RDl 114. A conductive epoxy 804 (or a solder) is between and electrically and mechanically connects the conductive protrusion 802 and the plating 604 of the transducer element 106. Similar to FIG. 6, in one instance, the filler 606 is located between the RDL 112 and the transducer element 106, and in another instance, the filter 606 is omitted.

Figure 9:
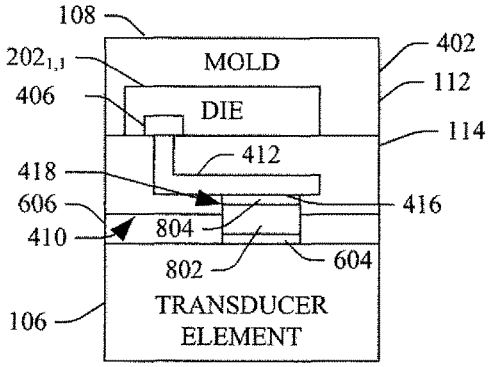

The embodiment of FIG. 9 is substantially similar to FIG. 8, except that the conductive protrusion 802 extends from the plating 604, and the conductive epoxy 804 (or a solder) is between and electrically and mechanically connects the end region 416 of the trace 412 and the conductive protrusion 802. Similar to FIG. 6, in one instance, the filler 606 is located between the RDL 112 and the transducer element 106, and in another instance, the filter 606 is omitted.

Figure 10:
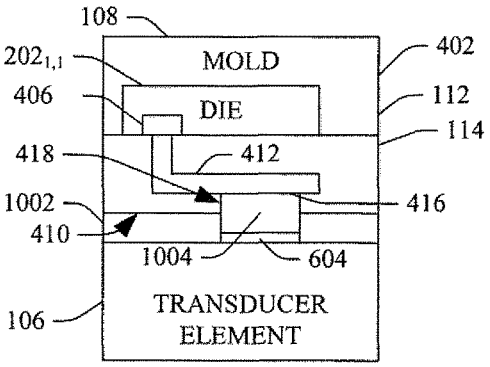

In FIG. 10, a non-conductive adhesive 1002 couples the RDL 114 and the transducer element 106. As shown, a conductive protrusion 1004 (e.g., a copper pillar, a raised elastomeric interconnect, or other material) electrically couples the end region 416 of the trace 412 and the plating 604 of the transducer element 106 via asperity contact of the two conductive surfaces. The non-conductive adhesive 1002 is primarily located between the side 410 of the RDL and the transducer element 106, for example, where the filler 606 in FIG. 6 is located, and mechanically couples the RDL 114 and the transducer element 106. There may also be a layer of non-conductive adhesive 1002 in the interface between the conductive protrusion 1004 and the plating 604, however this layer must be thin enough to allow the electrically conductive asperity contact between conductive protrusion 1004 and the plating 604, for instance of a thickness below 1 micron.

FIGS. 11, 12, 13, and 14 illustrate non-limiting example mappings of the RDL 114 from a view looking in the direction from the transducer array 104 to the component 108 (through the RDL 114 to the electronics 110 of the component 108).

Figure 11:
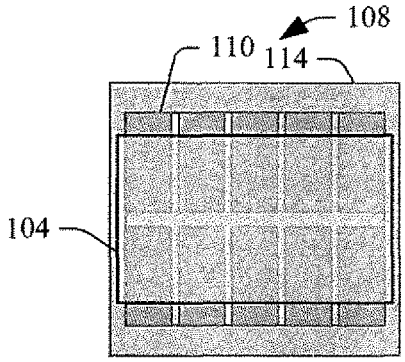
FIGS. 11, 12, 13 and 14 schematically illustrate example redistribution schemes between the transducer array and the embedded electronics.

Initially referring to FIG. 11, in this example, a geometrical footprint of the electronics 110 substantially aligns with a geometrical footprint of the transducer array 104. This may occur, for example, where a pitch of the dies 202 (FIGS. 2-10) of the electronics 110 is close to a pitch of the transducer elements 106 (FIG. 1) of the transducer 104. In such an instance, little redistribution is required by the RDL 114 as the electrical interconnects of the electronics 110 and the transducer array 104 are in substantial alignment.

Figure 12:
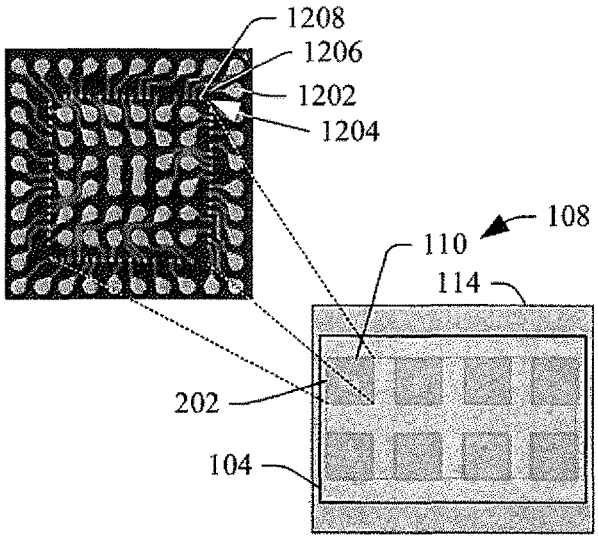

In FIG. 12, a geometrical footprint of the electronics 110 is smaller (less than half in the illustrated example) than the geometrical footprint of the transducer array 104. In this instance, the RDL 114, relative to the configuration shown in FIG. 11, redistributes more of signals from the transducer array 104 to the smaller footprint electronics 110, e.g., from the regions of the transducer array 104 that do not align with the smaller footprint of the electronics 110. Example redistribution is shown in which a transducer element pad 1202 of the RDL 114 located outside a perimeter 1204 of a die 202 is electrically coupled to, via a trace 1206 of the RDL 114, a die interconnect 1208. This configuration routes the signal from the pad 1202 to the die 202.

Figure 13:
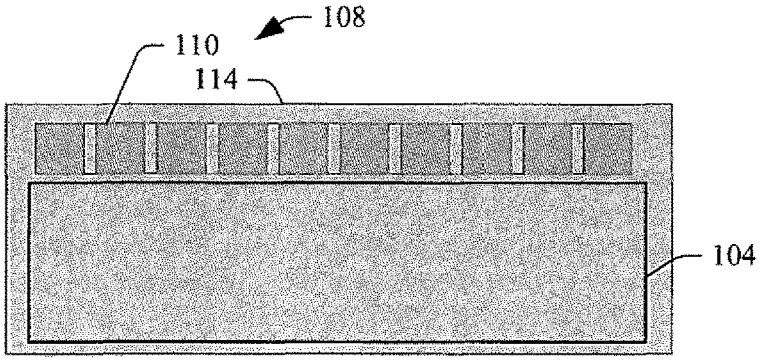

In FIG. 13, none of the electronics 110 aligns with the transducer array 104, and the RDL 114 routes all of the signals from the transducer array 104 to the electronics 110.

Figure 14:
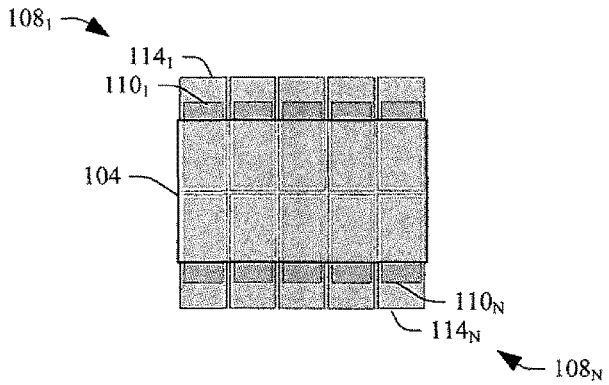

The embodiment of FIG. 14 is substantially similar to that of FIG. 11 except that the component 108 includes a plurality of sub-components $\mathbf{108}_1, \ldots, \mathbf{108}_N$, each with sub-electronics $\mathbf{110}_1, \ldots, \mathbf{110}_N$, and a sub-RDL $\mathbf{114}_1, \ldots, \mathbf{114}_N$, individually arranged with respect to each other and the transducer array 104. In the illustrated embodiment, each of the sub-components $\mathbf{108}_1, \ldots, \mathbf{108}_N$ includes a single die 202. However, it is to be understood that one or more of the sub-components $\mathbf{108}_1, \ldots, \mathbf{108}_N$ can include more than one die 202. This configuration may mitigate warping, thermal expansion, etc. relative to a configuration with less sub-components $\mathbf{108}_1, \ldots, \mathbf{108}_N$ for the transducer array 104.

Figure 15:
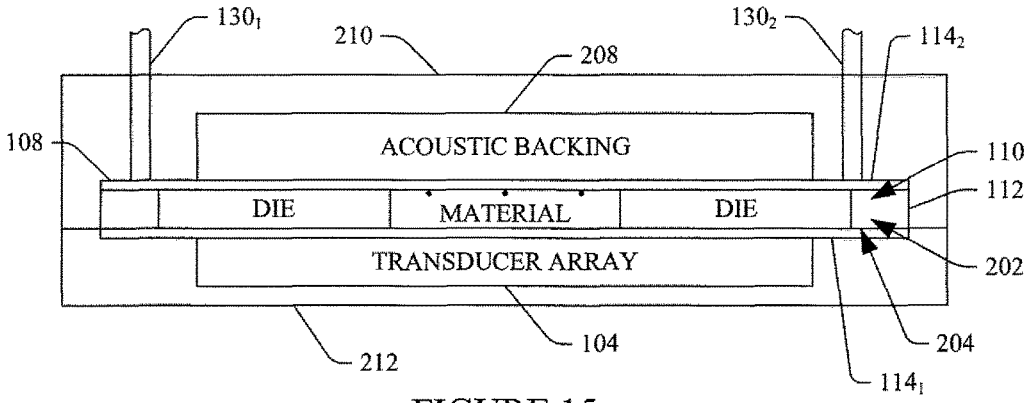
FIGS. 15 and 16 schematically illustrate other examples of the component with embedded electronics and the redistribution layer coupled to the transducer array.

FIG. 15 schematically illustrates a variation of the component 108.

The electronics 110 include the plurality of tiled dies 202 embedded in the material 112, for example, discussed in connection with FIGS. 2 and 3, and/or otherwise.

However, this variation includes at least two redistribution layers 114, a first redistribution layer $\mathbf{114}_1$, which is substantially similar or the same as the redistribution layer 114 shown in FIG. 2, and a second redistribution layer $\mathbf{114}_2$, which is located on an opposing side of the matrix 200 of dies 202.

In this example, readout interfaces $\mathbf{130}_1$ and $\mathbf{130}_2$ are in electrical communication with the second redistribution layer $\mathbf{114}_2$ and extend from and perpendicular to the second redistribution layer $\mathbf{114}_2$ and through and out of the encapsulate 210. In other variations, more or less readout interfaces 130 can be included, and/or could extend parallel to the second redistribution layer.

In this example, the acoustic backing 208 is affixed at a side of the second redistribution layer $\mathbf{114}_2$, and the optional encapsulate 210 at least covers portions of the second redistribution layer $\mathbf{114}_2$, portions of the material 112, and the readout interfaces $\mathbf{130}_1$ and $\mathbf{130}_2$.

The acoustic window 212 at least covers portions of the transducer array 104, the first redistribution layer $\mathbf{114}_1$, and the material 112.

Figure 16:
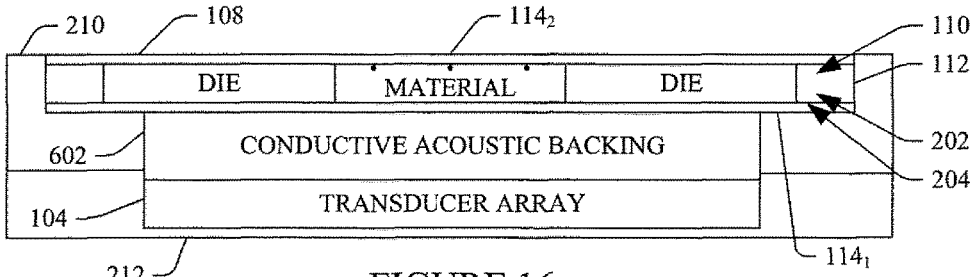

FIG. 16 schematically illustrates another variation of the component 108.

The electronics 110 include the plurality of tiled dies 202 embedded in the material 112, for example, discussed in connection with FIGS. 2, 3 and/or 5, and/or otherwise. Similar to FIG. 5, this variation also includes the first and second redistribution layer $\mathbf{114}_1$ and $\mathbf{114}_2$.

However, in this variation, the acoustic backing 208 is omitted, and a selectively conductive acoustic backing 602 is located between the first redistribution layer $\mathbf{114}_1$ and the transducer array 104. An example of a selectively conductive acoustic backing 602 is a matrix of imbedded conductors or selectively conductive paths that align with each transducer element 106. Another example of a selectively conductive acoustic backing is a material with selectively conductive proprieties along the vertical z axis. Furthermore, the second conductive redistribution layer $\mathbf{114}_2$ is utilized as the readout interface 130.

With this configuration, the acoustic impedance of the acoustic backing 602 need not substantially match that of the dies 202, and the acoustic backing 602 could optimize the acoustic performance of the transducer array 104.

In this example, the optional encapsulate 210 at least covers portions of the second redistribution layer $\mathbf{114}_2$, the material 112, the first redistribution layer $\mathbf{114}_1$, and the conductive acoustic backing 602.

The acoustic window 212 at least covers portions of the conductive acoustic backing 602 and transducer array 104.

The readout interfaces can be as shown in FIG. 15 in electrical communication with the second redistribution layer $\mathbf{114}_2$ or as shown in FIG. 2 in electrical communication with the first redistribution layer $\mathbf{114}_1$. In the latter case, the conductive redistribution layer $\mathbf{114}_2$ can be omitted.

Figure 17:
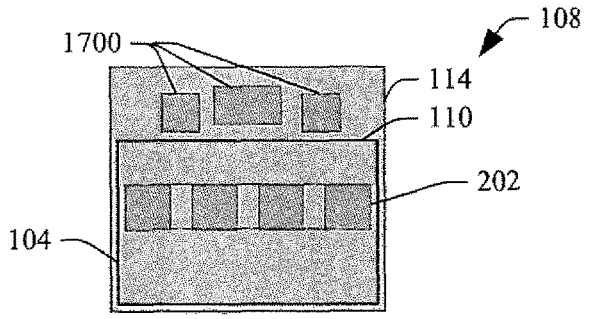
FIG. 17 schematically illustrates an example in which the component further includes embedded circuitry with control and/or echo processing functionality.

FIG. 17 illustrates a variation in which the component 108 further includes circuitry 1700 for controlling (e.g., transmit, receive, and/or other operations) one or more of the dies 202 and/or processing signals generated by one or more of the dies 202 indicative of a received echo. Other functionality of the console 116 (FIG. 1) can also be include in the circuitry 1700 and/or other circuitry of the component 108. Such a configuration can further reduce the number of I/O lines to and from the component 108, relative to a configuration in which the circuitry 1700 is not included in the component 108. In FIG. 2, in one non-limiting instance, the dies 202 are all be identical in that they include circuitry for performing the same functions.

Figure 18:
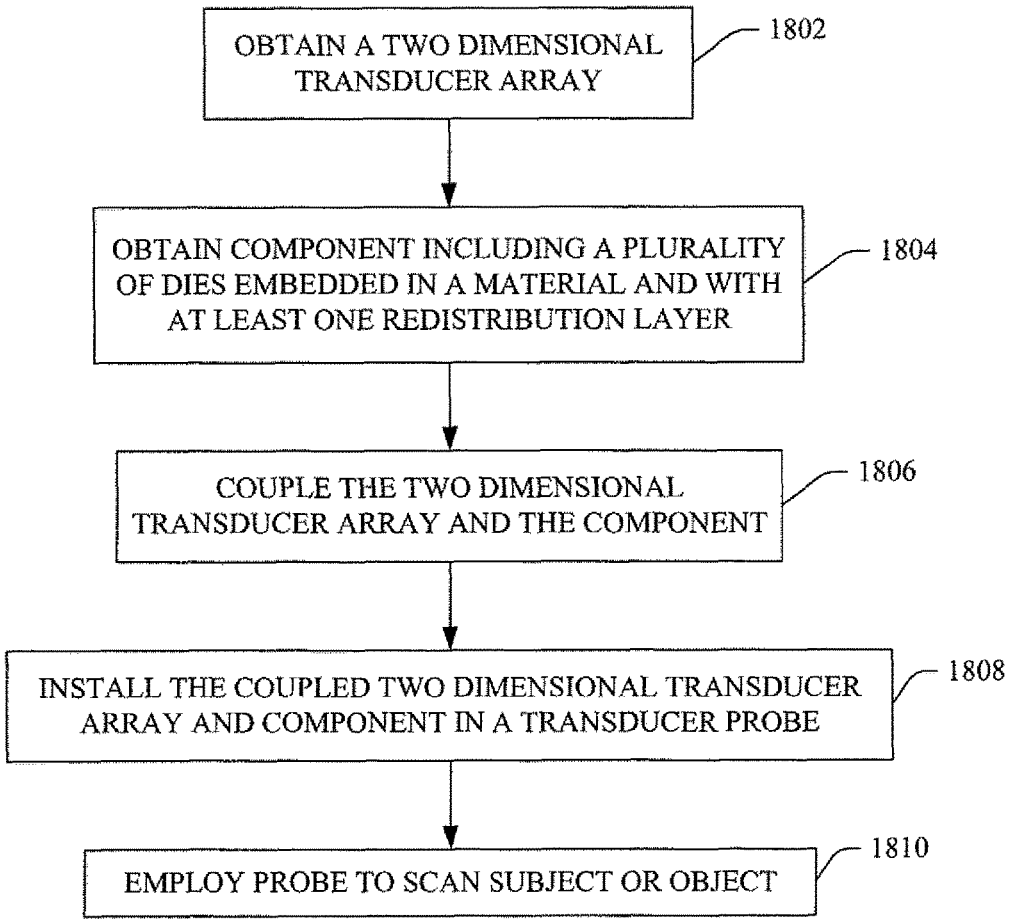
FIG. 18 illustrates an example method in accordance with the embodiments disclosed herein.

FIG. 18 illustrates a method in accordance with the embodiments disclosed herein.

It is to be appreciated that the order of the following acts is provided for explanatory purposes and is not limiting. As such, one or more of the following acts may occur in a different order. Furthermore, one or more of the following acts may be omitted and/or one or more additional acts may be added.

At 1802, a two dimensional transducer array with a plurality of transducer elements is obtained.

At 1804, a component that includes electronics embedded in a material and at least one distribution layer in electrical communication with the electronics is obtained.

At 1806, the two dimensional transducer array and the component are coupled through the at least one distribution layer, where the plurality of transducer elements and the electronics are in electrical communication through the at least one distribution layer.

At 1808, the two dimensional transducer array and the component are installed in an ultrasound probe.

At 1810, the ultrasound probe is utilized to scan an object or subject.

The application has been described with reference to various embodiments. Modifications and alterations will occur to others upon reading the application. It is intended that the invention be construed as including all such modifications and alterations, including insofar as they come within the scope of the appended claims and the equivalents thereof.

What is claimed is:

1. An ultrasound system, comprising:

an ultrasound transducer array comprising a 2D array of a plurality of transducer elements on a major surface;

a single mold comprising of a material embedded with at least three dies in a same plane therein and including a first side and a second side which is opposite the first side;

a redistribution layer disposed between the major surface and the first side, wherein the redistribution layer physically contacts and directly electrically couples the plurality of transducer elements to the at least three dies, and wherein the major surface is located on one side of the redistribution layer and the first side is on an opposing side of the redistribution layer; and a single acoustic backing disposed only on the second side of the material.

2. The ultrasound system of claim 1, wherein the component is one of a Fan Out Wafer Level Packaging or an Embedded Wafer Level Ball Grid Array based component.

3. The ultrasound system of claim 1, wherein the material includes a mold compound.

4. The ultrasound system of claim 1, wherein the material includes a printed circuit board.

5. The ultrasound system of claim 1, wherein the plurality of dies includes a two dimensional matrix of the dies.

6. The ultrasound system of claim 1, wherein the dies are tiled in a same plane.

7. The ultrasound system of claim 1, wherein a die includes an electrical contact and the redistribution layer includes an electrical conductive trace that extends through the redistribution layer from the electrical contact to the opposing side, forming a contact pad.

8. The ultrasound system of claim 7, the ultrasound transducer array, comprising at least one transducer element; and at least one electrical contact of the at least one transducer element, wherein the contact pad and the at least one electrical contact are electrically coupled.

9. The ultrasound system of claim 8, further comprising:

a conductive coupling that electrically couples the contact pad and the at least one electrical contact and that mechanically couples the redistribution layer and the ultrasound transducer array.

10. The ultrasound system of claim 8, further comprising:

a conductive protrusion that electrically couples the contact pad and the at least one electrical contact; and a non-conductive coupling that mechanically couples the redistribution layer and the ultrasound transducer array.

11. The ultrasound system of claim 1, further comprising:

at least one readout interface in electrical communication with the redistribution layer; and an acoustic window that covers at least a portion of the at least one readout interface and at least a portion of the ultrasound transducer array.

12. The ultrasound system of claim 1, further comprising:

a second redistribution layer one a side of the material opposing the redistribution layer and in electrical in communication with the electronics; and at least one readout interface in electrical communication with the second redistribution layer; and an acoustic window that covers at least a portion of the at least one readout interface and at least a portion of the ultrasound transducer array.

13. The ultrasound system of claim 1, further comprising:

a second redistribution layer on one a side of the material opposing the redistribution layer and in electrical in communication with the electronics, wherein the second redistribution layer provides a readout interface.

14. The ultrasound system of claim 1, further comprising:

a control and/or processing portion;

an integrated display;

a user interface; and a single enclosure, wherein the single enclosure houses the control and/or processing portion, the integrated display, the user interface, the ultrasound transducer array, and the component.

15. The ultrasound system of claim 1, further comprising:

a probe, wherein the probe houses the ultrasound transducer array and the component; and a console, wherein the probe and console are separate devices and in electrical communication.

16. A hand-held ultrasound scanner, comprising:

a housing;

an ultrasound device, including:

an ultrasound transducer array comprising a 2D array of a plurality of transducer elements on a major surface;

a single mold comprising of a material embedded with at least three dies in a same plane therein and including a first side and a second side which is opposite the first side;

a redistribution layer disposed between the major surface and the first side, wherein the redistribution layer physically contacts and directly electrically couples the plurality of transducer elements to the at least three dies, and wherein the major surface is located on oen side of the redistribution layer and the first side is on an opposing side of the redistribution layer;

a single acoustic backing disposed only on the second side of the material, a control and/or processing portion, wherein the housing is a single enclosure that houses the ultrasound device and the control and/or processing portion.

17. The hand-held ultrasound scanner of claim 16, further comprising:

at least one readout interface in electrical communication with the redistribution layer; and an acoustic window that covers at least a portion of the at least one readout interface and at least a portion of the ultrasound transducer array.

18. The hand-held ultrasound scanner of claim 16, wherein the material includes one of a mold compound or printed circuit board.

19. The hand-held ultrasound scanner of claim 16, wherein the electronics includes a two dimensional matrix of the dies tiled in a linear or curved plane.

20. The hand-held ultrasound scanner of claim 16, further comprising:

a second redistribution layer one a side of the material opposing the redistribution layer and in electrical in communication with the electronics;

at least one readout interface in electrical communication with the second redistribution layer; and an encapsulate that covers at least a portion of the acoustic backing and at least a portion of the at least one readout interface.

21. The hand-held ultrasound scanner of claim 20, wherein the conductive coupling includes a silver epoxy.

22. The hand-held ultrasound scanner of claim 16, further comprising:

a second redistribution layer on one a side of the material opposing the redistribution layer and in electrical in communication with the electronics, wherein the second redistribution layer provides a readout interface.

23. The hand-held ultrasound scanner of claim 21, wherein the conductive protrusion includes one of a copper pillar or a raised elastomeric interconnect.

24. The hand-held ultrasound scanner of claim 21, wherein the conductive protrusion is part of and extends from one of the ultrasound transducer array or the redistribution layer.

25. The hand-held ultrasound scanner of claim 16, further comprising:

electrical circuitry configured to perform at least one of an ultrasound control operation or an ultrasound echo processing operation, wherein the electrical circuitry is embedded in the material.

26. The hand-held ultrasound scanner of claim 16, wherein a footprint of the transducer array is approximately a same geometry as a footprint of the electronics and the redistribution layer passes signals from the transducer array to the electronics.

27. The hand-held ultrasound scanner of claim 16, wherein a footprint of the transducer array is larger than a footprint of the electronics and the redistribution layer routes signals from a sub-portion of the transducer array outside of the footprint of the electronics to the electronics.

28. The hand-held ultrasound scanner of claim 16, further comprising:

an integrated display.

29. The hand-held ultrasound scanner of claim 16, further comprising:

an internal power source.

* * * * *